United States Patent [19]

Himmelmann et al.

[11] 4,338,394

[45] Jul. 6, 1982

[54] PROCESS FOR HARDENING PHOTOGRAPHIC GELATIN

[75] Inventors: Wolfgang Himmelmann, Leverkusen; Peter Bergthaller, Cologne; Johannes Sobel, Leverkusen, all of Fed. Rep. of Germany

[73] Assignee: Agfa-Gevaert Aktiengesellschaft, Leverkusen, Fed. Rep. of Germany

[21] Appl. No.: 220,756

[22] Filed: Dec. 29, 1980

[30] Foreign Application Priority Data

Jan. 8, 1980 [DE] Fed. Rep. of Germany ..... 3000407

[51] Int. Cl.[3] ..... G03C 1/30

[52] U.S. Cl. ..... 430/621; 430/623; 430/626; 260/117; 106/125

[58] Field of Search ..... 430/621, 623, 626; 260/117; 106/125

[56] References Cited

U.S. PATENT DOCUMENTS

| | | | |
|---|---|---|---|
| 3,392,023 | 7/1968 | Burness | 430/621 |
| 3,834,902 | 9/1974 | Wright | 430/621 |
| 3,853,940 | 12/1974 | Tesoro et al. | 260/117 |
| 4,142,897 | 3/1979 | Habu et al. | 260/117 |

*Primary Examiner*—Won H. Louie, Jr.

*Attorney, Agent, or Firm*—Connolly and Hutz

[57] ABSTRACT

Gelatin-containing layers of photographic materials are hardened by adding a compound containing from 2 to 6 sulfonyl ethyl sulfate groups in the form of its salts and activating the compound by adjusting a pH-value in the range from 6.5 to 11.

5 Claims, 1 Drawing Figure

PROCESS FOR HARDENING PHOTOGRAPHIC GELATIN

Figure 1:
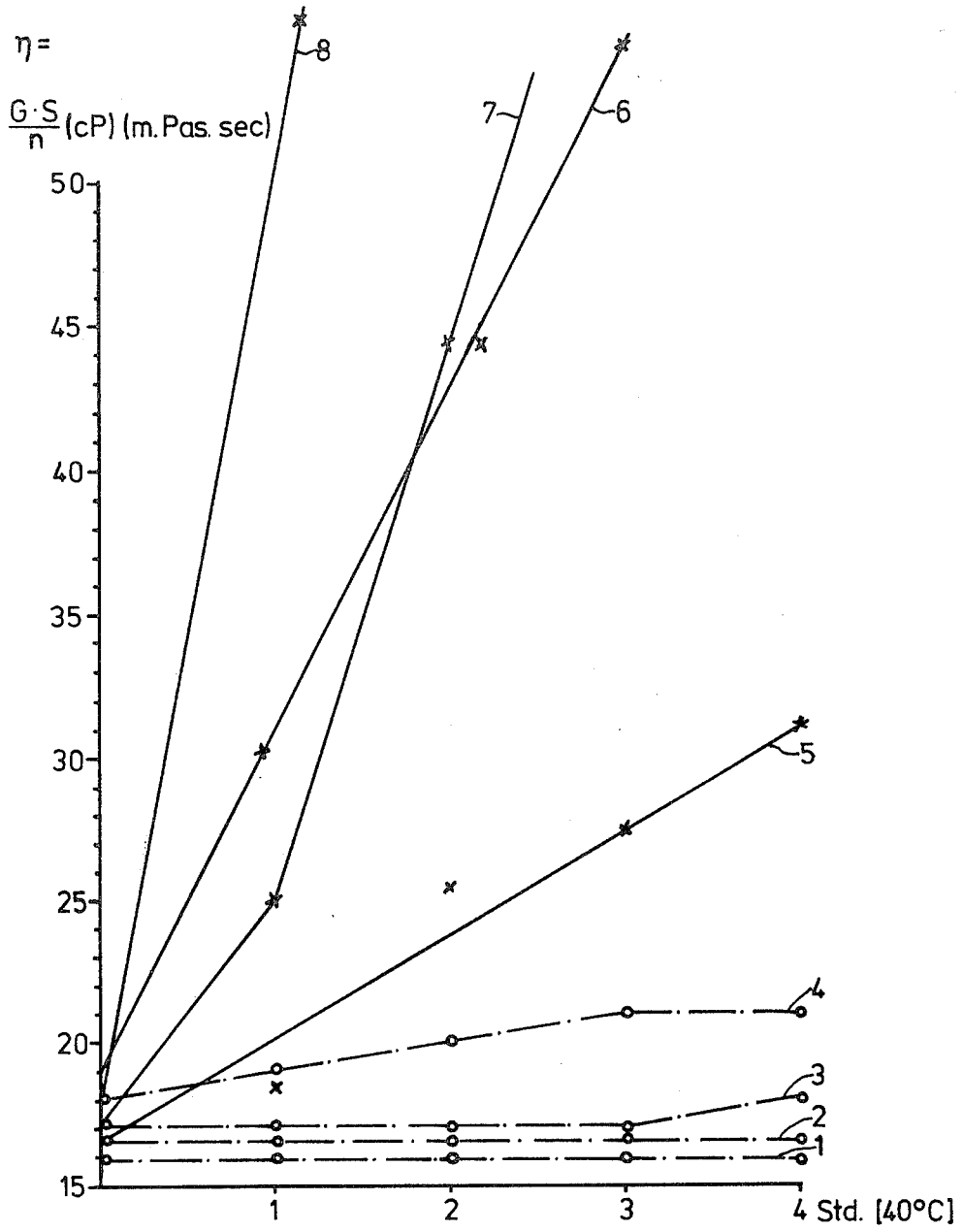

This invention relates to a process for hardening photographic gelatin or photographic layers containing photographic gelatin.

Numerous substances have already been described as hardeners for proteins and, in particular, for gelatin. Substances such as these include, for example, metal salts, such as chromium, aluminium or zirconium salts; aldehydes and halogen-containing aldehyde compounds, particularly formaldehyde, dialdehydes and mucochloric acid; 1,2- and 1,4-diketones, such as cyclohexane-1,2-dione, quinones, chlorides of dibasic organic acids, the anhydrides of tetracarboxylic acids, compounds containing several reactive vinyl groups, such as vinyl sulfones, acrylamides, compounds containing at least two readily cleavable, heterocyclic 3-membered rings, such as ethylene oxide and ethylene imine, polyfunctional methane sulfonic acid esters and bis-α-chloroacylamido compounds.

High molecular weight hardeners such as, for example, polyacrolein and its derivatives or copolymers and alginic acid derivatives have recently become known, being used specifically as layer-bound hardeners.

However, the use of the above-mentioned compounds for photographic purposes involves a number of serious disadvantages. Some of these compounds are photographically active and are therefore unsuitable for hardening photographic materials, whilst other affect the physical properties, such as for example the fragility, of the gelatin layers so adversely that they cannot be used. Others give rise to discolouration or to a change in the pH-value during the hardening reaction. In addition, it is particularly important, so far as the hardening of photographic layers is concerned, that hardening should reach its maximum as soon as possible after drying, to ensure that the permeability to the developer solution of the material to be hardened does not change continually, as is the case for example with mucochloric acid or formaldehyde.

In certain cases, crosslinking agents for gelatin also have a damaging effect on the skin, as is the case for example with ethylene imine compounds, so that their use is not recommended for physiological reasons alone.

It is also known that trichlorotriazine, hydroxy dichlorotriazine and dichloroaminotriazines can be used as hardeners. Disadvantages of hardeners such as these include their relatively high vapour pressure, the elimination of hydrochloric acid during the hardening process and the physiological effect of these compounds. Water-soluble derivatives which contain carboxyl and sulfonic acid groups and which are obtained by reacting cyanuric chloride with 1 mole of aminoalkyl or diaminoaryl sulfonic acid or carboxylic acid do not have any of these disadvantages and, for this reason, have recently been proposed as hardeners. However, their usefulness in practice is limited by the fact that, because of their high solubility, they decompose on standing in aqueous solutions and, as a result, soon lose their effectiveness.

Finally, it is of the utmost importance to any hardener for photographic gelatin-containing layers, both for production reasons and also for processing reasons, that it should also be possible to determine the onset of the crosslinking reaction within certain limits, for example through the choice of the drying temperature or through the choice of the pH-value.

Other known hardeners for photographic gelatin layers are compounds containing two or more acrylic acid amido groups in the molecule, N,N',N''-trisacryloyl hydrotriazine or methylene-bis-acrylamide.

Although the hardening of the compounds is good after a while, the compounds are sparingly soluble in water which can give rise to irregularities in hardening within the layer.

Particular problems arise in the high-speed processing of photographic materials, particularly colour photographic materials, which processing is being used to an increasing extent and which imposes increased demands on the mechanical properties and swelling behaviour of the materials. Added to these problems are the difficulties which arise from the need to produce increasingly thinner photographic layers. Attempts have been made to solve problems of this nature by using different types of hardeners. However, the known hardeners have either given rise to new difficulties or have simply proved to be unsuitable.

Hardeners of this type include the numerous known hardeners containing vinyl sulfone groups, of which divinyl sulfone is the most well known (German Pat. No. 872,153). The use of divinyl sulfone is prevented by its toxicity.

In addition, German Pat. No. 1,100,942 describes aromatic vinyl sulfone compounds whilst German Offenlegungsschrift No. 1,147,733 describes heterocyclic vinyl sulfone compounds containing nitrogen or oxygen as heteroatoms. Finally, German Pat. No. 1,808,685 and German Offenlegungsschrift No. 2,348,194 describe bis-vinyl sulfonyl alkyl compounds as hardeners.

The known vinyl sulfone compounds have proved in many respects to be unsatisfactory as hardeners. They are either inadequately soluble in water and necessitate special measures to make it possible for them to be used in photographic gelatin layers or, alternatively, they affect adversely the drying behaviour of the layers. One particular disadvantage of these compounds is that they increase the viscosity of the casting solution to such an extent that casting is seriously affected.

The object of the present invention is to provide a hardening process for photographic gelatin-containing layers by which it is possible to prevent disturbances during the casting process caused by increases in the viscosity of the casting solutions through premature crosslinking of the gelatin, which does not affect adversely the photographic properties of photographic materials, particularly colour photographic materials, and which does not give rise to any difficulties during the subsequent processing of the materials in photographic baths.

The present invention relates to a process for hardening a photographic material consisting of a support layer and at least one gelatin-containing layer applied thereto, with a compound reacting with the amino groups of the gelatin as crosslinking agent, characterised in that a compound containing from 2 to 6 sulfonyl ethyl sulfate groups in the form of its salts is incorporated as crosslining agent in the coating composition of the gelatin-containing layer(s) or in the gelatin-containing layer(s) applied to the support layer and in that the activity of the compound as a crosslinking agent is initiated by adjusting a pH-value in the range from 6.5 to 9 in the coating composition or in the range from 6.5 to 11 during the production process in the gelatin-containing layer.

The compounds used as crosslinking agents in accordance with the invention correspond to the following general formula $$Z(-Y-SO_2-CH_2-CH_2-OSO_3^{\ominus}Me^{\oplus})_n$$

in which Z represents a difunctional to n-functional aliphatic, saturated or olefinically unsaturated, straight- or branched-chain, $C_1$–$C_9$-hydrocarbon radical which may be substituted and which may contain oxy groups, a difunctional to n-functional, 6-membered, cycloaliphatic, aromatic or heterocyclic radical which may be substituted such as, for example, a radical derived from cyclohexane, benzene, piperazine or hexahydrotriazine, or the group $$NaSO_3-O-\underset{H}{C}=,$$

Y represents a single bond or a branched or unbranched $C_1$–$C_4$-alkylene group which may contain oxy, carbonyl and imino groups and, n is an integer of from 1 to 6.

In general, the pH-value may be adjusted with salts of volatile inorganic or organic acids, particularly for example carbonic acid, acetic acid or propionic acid, with non-volatile cations of alkaline-earth/alkali metals or zinc ions.

The pH-value may also be adjusted with buffer mixtures. Suitable mixtures include primary potassium phosphate/secondary sodium phosphate, in whose case pH-stages up to 8 may be obtained, hydrochloric acid/-sodium borate which is effective up to pH 9, sodium borate/sodium hydroxide or glycocoll/sodium hydroxide effective up to pH 11 and pH 13.

The following are examples of crosslinking compounds suitable for use in the process according to the invention:

1. $C(CH_2-SO_2-CH_2-CH_2-O-SO_3^{\ominus}Na^{\oplus})_4$

2. $C(CH_2-O-CH_2-SO_2-CH_2-CH_2-OSO_3^{\ominus}Na^{\oplus})_4$

3. $C_2H_5-C(CH_2-SO_2-CH_2-CH_2-OSO_3^{\ominus}Na^{\oplus})_3$

4. $CH_3-C(CH_2-SO_2-CH_2-CH_2-O-SO_3^{\ominus}Na^{\oplus})_3$

5. $C_8H_{17}-C(CH_2-SO_2-CH_2-CH_2-O-SO_3^{\ominus}Na^{\oplus})_3$

6. $\begin{array}{l} CH_2-SO_2-CH_2-CH_2-O-SO_3^{\ominus}K^{\oplus} \\ | \\ CH_2-SO_2-CH_2-CH_2-O-SO_3^{\ominus}K^{\oplus} \end{array}$ 7. $\begin{array}{l} CH_2-SO_2-CH_2-CH_2-O-SO_3^{\ominus}K^{\oplus} \\ | \\ O \\ | \\ CH_2-SO_2-CH_2-CH_2-O-SO_3^{\ominus}K^{\oplus} \end{array}$ 8. 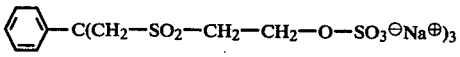

9. $\begin{array}{l} CH_2-(CH_2-SO_2-CH_2-CH_2-SO_3^{\ominus}Na^{\oplus}) \\ | \\ CH-(CH_2-SO_2-CH_2-CH_2-SO_3^{\ominus}Na^{\oplus}) \\ | \\ CH_2-(CH_2-SO_2-CH_2-CH_2-SO_3^{\ominus}Na^{\oplus}) \end{array}$ -continued 10. 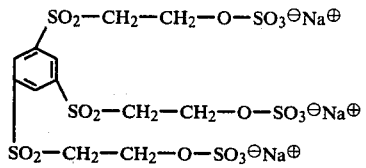

11. 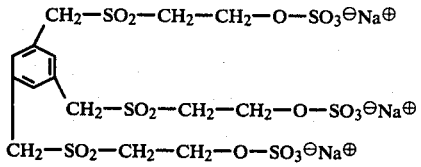

12. 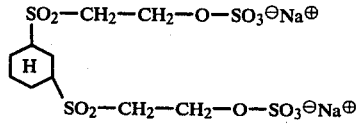

13. 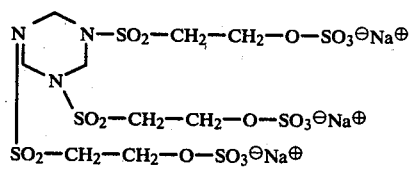

14. 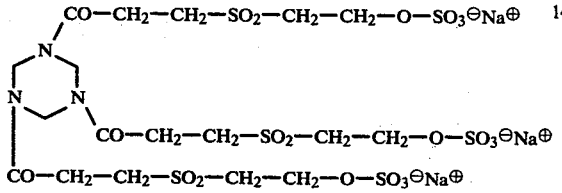

15. 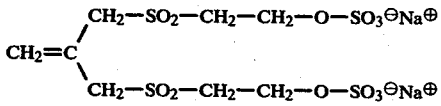

16. 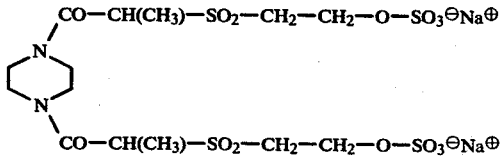

17. $\begin{array}{l} CH_2-NH-CO-CH_2-CH_2-SO_2-CH_2-CH_2-OSO_3^{\ominus}Na^{\oplus} \\ | \\ CH_2-NH-CO-CH_2-CH_2-SO_2-CH_2-CH_2-OSO_3^{\ominus}Na^{\oplus} \end{array}$ 18. $Na^{+}SO_3-O-CH\begin{array}{l} CH_2-SO_2-CH_2-CH_2-OSO_3^{\ominus}Na^{\oplus} \\ CH_2-SO_2-CH_2-CH_2-OSO_3^{\ominus}Na^{\oplus} \end{array}$ The process by which the crosslinking compounds are produced is described in the following with reference to the production of compounds 1, 4, 18, 15 and 17. All of the other compounds may be similarly produced.

PRODUCTION OF COMPOUND 1

10.1 g of tetrakis-hydroxyethyl-sulfonylmethylmethane $$C(CH_2-SO_2-CH_2-CH_2-OH)_4$$

are stirred into 50 ml of absolute dioxane. 18.6 g of chlorosulfonic acid are added dropwise with cooling at 10° C. The mixture is then further stirred at room temperature. After a short time, a clear solution is formed. After standing for 3 days at room temperature, a colourless reaction product is precipitated. It is filtered off inder suction and washed 2 to 3 times with a little cold dioxane. The substance is dried over phosphorus pentoxide. Yield: 17 g.

The compound is dissolved in concentrated form in ice water and a pH-value of 5 is adjusted by the addition of aqueous sodium bicarbonate solution. The aqueous solution is concentrated by vacuum evaporation to dryness. The product is rubbed with acetone and filtered under suction. Yield: 22 g. According to NMR-measurement, the compound does not contain any vinyl sulfone groups.

PRODUCTION OF COMPOUND 18

27.6 g of the following compound

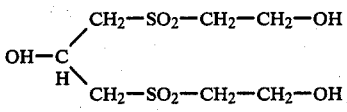

produced in accordance with German Offenlegungsschrift No. 2,742,308, are dispersed in 200 ml of dioxane. 46.6 g of chlorosulphonic acid are slowly added dropwise to the mixture at 10° C. with external cooling. The mixture is then left standing at room temperature and precipitated with absolute ether. The highly viscous syrup is washed a few times with ether. The residue is dissolved in absolute acetone, filtered and the solution concentrated by evaporation in vacuo. Yield: 53 g.

The residue is dissolved in ice water and the mixture is adjusted to pH 5 with sodium bicarbonate solution. The insoluble fraction is extracted by shaking with ether and the aqueous solution is clarified with Fuller's earth. Yield 46 g. (in the form of a 16% solution).

PRODUCTION OF COMPOUND 15

27.2 g of the following compound

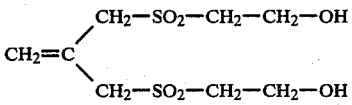

are suspended in 200 ml of absolute dioxane. 35 g of chlorosulfonic acid are slowly added dropwise to the mixture with gentle cooling at 10° C. The mixture remains standing for 24 hours at room temperature. No more starting material can be detected by thin-layer chromatography. The solution is filtered and the solvent is evaporated off in vacuo. The residue is rubbed a few times with ether. The residue is then dissolved with ice water and the pH-value is adjusted immediately to 5 with sodium bicarbonate solution. Yield: 41 g (in the form of 12% solution).

PRODUCTION OF COMPOUND 17

38.8 g of the following compound

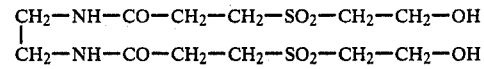

are dispersed in 200 ml of absolute dioxane. 35 g of chlorosulfonic acid are added dropwise to the mixture with thorough stirring in the absence of moisture, followed by stirring for 4 hours at room temperature. The compound is deposited in the form of a wax-like substance. It is rubbed repeatedly with absolute ether, subsequently dissolved in ice water and the pH-value of the resulting solution immediately adjusted to pH 5 with sodium bicarbonate solution. Yield: 45 g (in the form of a 20% solution).

The hydroxy ethyl sulfone compounds required for the reaction may be obtained in known manner, as described in Ullmann, Vol. 14, page 620, in Houben-Weyl Vol. IX, page 247 or in German Pat. No. 965,902, for example via the corresponding halogen alkanes by reaction with hydroxy alkyl mercaptans and oxidation of the resulting sulfides with hydrogen peroxide to form the hydroxyethyl sulfones.

The crosslinking agents used in accordance with the invention may be added to the casting solution either sometime before casting or immediately before casting using metering units. The compounds may also be added to an overcoating solution which is applied as a hardening overcoat after production of the photographic material. The final layer assemblage may also be drawn through a solution of the crosslinking agents and, as a result, receive the necessary quantity of crosslinking agents. Finally, in the case of multilayer materials, for example colour films and colour paper, the crosslinking agents according to the invention may be introduced into the overall layer structure via the intermediate layers.

In the process according to the invention, the crosslinking agents are generally used in a quantity of from 0.01 to 15% by weight and preferably in a quantity of from 0.1 to 10% by weight, based on the dry weight of the gelatin in the coating solution. Although the time at which the addition is made to the coating solution is not critical, silver halide emulsions are best added to the hardener after chemical ripening.

The agents used to adjust the pH-value are employed in at most molar quantities, based on the number of sulphate groups in the crosslinking agent.

The salts of volatile acids with non-volatile cations which were mentioned first may be incorporated in the coating compositions or layers together with or separately from the crosslinking agent. By contrast, the buffer mixtures cannot be used together with the crosslinking agent. Instead, the buffer mixtures are added to the coating compositions containing the crosslinking agent shortly before or during casting of the layers. Even when it is intended to incorporate the crosslinking agent in a finished layer assemblage by means of an overcoating bath, it is best not to incorporate the buffer mixture into the bath until the crosslinking agent has diffused into the layer assemblage and has been uniformly fixed in the layers of the assemblage to be hardened. It is of course also possible to incorporate the buffer mixture in the coating composition and subsequently to introduce the crosslinking agent into the coating composition or the layer by any of the methods described above.

In cases where a pH-value in the range from 6.5 to 11 is not adjusted in accordance with the invention, the crosslinking reaction is subsequently initiated when the photographic material containing the crosslinking agent comes into contact with alkaline developer baths. However, since in this case the photographic material remains in a labile state from its production up to its processing, which is undesirable so far as hardening is concerned, this variant is of no practical significance.

In the context of the invention, photographic layers are understood quite generally to be layers of the type used in photographic materials, for example photosensitive silver halide emulsion layers, protective layers, filter layers, anti-halation layers, backing layers or, quite generally, photographic auxiliary layers.

Photosensitive emulsion layers for which the hardening process according to the invention is particularly suitable are, for example, layers of the type based on non-sensitized emulsions, X-ray emulsions and other spectrally sensitized emulsions. The process according to the invention is also suitable for hardening the gelatin layers used for the various photographic black-and-white and colour processes, such as negative positive and diffusion transfer processes or printing processes. The process according to the invention has proved to be of particular advantage for hardening photographic layer assemblages of the type intended for carrying out colour photographic processes, for example layer assemblages which contain emulsion layers with colour couplers or emulsion layers intended for treatment with solutions containing colour couplers.

The effect of the compounds used in accordance with the invention is not adversely affected by any of the usual photographic additives. The hardening agents are also unaffected by photographically active substances, such as water-soluble and emulsified water-insoluble dye components, stabilizers, sensitizers and the like. Neither do they have any detrimental effect upon the photosensitive silver halide emulsion.

The emulsion layers may contain as photosensitive constituents any known silver halides, such as silver chloride, silver iodide, silver bromide, silver iodobromide, silver chlorobromide and silver chloroiodobromide. The emulsions may be chemically sensitised by noble metal compounds, for example by compounds of ruthenium, rhodium, palladium, iridium, platinum or gold, such as ammonium chloropalladate, potassium chloroplatinate, potassium chloropalladate or potassium chloroaurate. They may also contain special sensitizers such as sulfur compounds, tin(II) salts, polyamines or polyalkylene oxide compounds. In addition, the emulsions may be optically sensitized with cyanine dyes, merocyanine dyes and mixed cyanine dyes.

Finally, the emulsions may contain a variety of couplers, for example colourless couplers, coloured couplers, stabilizers, such as mercury compounds, triazole compounds, azaindene compounds, benzothiazolium compounds or zinc compounds, wetting agents such as dihydroxy alkanes, agents which improve the film-forming properties, for example the particulate high polymers dispersed in water obtained in the emulsion polymerisation of alkyl acrylate or alkyl methacrylate, acrylic acid or methacrylic acid, styrene/maleic acid copolymers or styrene/maleic acid anhydrides semialkyl ester copolymers, coating aids, such as polyethylene glycol lauryl ether, and a variety of other photographic additives.

It is remarkable that, when used in colour photographic materials containing couplers, such as for example magenta couplers of the 5-pyrazolone type, cyan couplers of the naphthol or phenol type and yellow couplers of the closed ketomethylene type, so-called 2-valent and 4-valent couplers derived from the couplers mentioned above and so-called masking couplers containing an aryl azo group on the active site, the crosslinking agents according to the invention do not produce any changes in colour in the photographic materials.

The crosslinking agents according to the invention are distinguished from known hardeners of the vinyl sulfonyl type in particular by the fact that in no case do they increase the viscosity of the casting solutions by premature crosslinking in solution. This unfavourable behaviour is found in known vinyl sulfonate hardeners, particularly in compounds containing more than two reactive vinyl sulfonyl groups. The casting solutions can be stored for only brief periods and considerable capital outlay is involved in overcoming the resulting difficulties.

EXAMPLE 1

A comparison was made of the increase in the viscosity of 10% aqueous gelatin solutions as a function of time and pH-value under the effect of a compound corresponding to the invention and two hardeners which do not correspond to the invention. Quantities of 1% by weight of the hardeners, based on gelatin, were added to 10% aqueous gelatin solutions.

The following compounds were used for comparison:

$$C(CH_2-SO_2-CH=CH_2)_4 \qquad \text{VV1}$$

$$(CH_2=CH-SO_2-CH_2)_3\equiv C-CH_2-SO_2CH_2-CH_2-NH-CH_2-CH_2-SO_3^{\ominus}Na^{\oplus} \qquad \text{VV2}$$

Compound 1 according to the invention $$C(CH_2-SO_2-CH_2-CH_2-O-SO_3^{\ominus}Na^{\oplus})_4$$

The viscosities at 40° C. were measured at hourly intervals. The mixtures were digested for a prolonged period (approximately 5 hours) at 40° C. The behaviour of the samples was studied at pH-values of 6, 6.5, 7 and 7.5. The pH-values were adjusted by means of a buffer mixture of primary potassium phosphate and secondary sodium phosphate (6,6.5) and sodium carbonate (7, 7.5).

The results are shown in FIG. 1. The chain-line curves 1 to 4 apply to compound 1 according to the invention and to the pH-values 6 (curve 1), 6.5 (curve 2), 7 (curve 3) and 7.5 (curve 4). The solid-line curves 5 (pH 6) and 6 (pH 6.5) apply to the comparison compound VV1, whilst curves 7 and 8 apply to the comparison compound VV2. The comparison compound VV1 crosslinks the gelatin after 4 hours at a pH of 6.5 in accordance with curve 6. Comparison compound VV2 also crosslinks the gelatin after about 4 hours at pH 6 (curve 7) and after only 2 hours at pH 6.5 (curve 8).

The results clearly show that, in the case of the compounds which do not correspond to the invention, there is a marked increase in viscosity after a few hours, whereas the compound according to the invention does not produce any increase in viscosity at either pH-value. Accordingly, 10% gelatin casting solutions cannot be digested with the comparison compounds VV1 and VV2. in addition to which irregularities attributable to an increase in viscosity are obtained during coating on the coated substrate.

EXAMPLE 2

Quantities of 1 g and 5 g of the compounds according to the invention (based on 100 g of gelatin) in the form of an aqueous bicarbonate-alkaline solution (1.2 and 5 g of sodium bicarbonate) are added at pH 6.2 to 100 ml of a photographic silver bromide gelatin emulsion ready for casting containing 10% by weight of gelatin. The mixture was thoroughly stirred, applied to a prepared cellulose triacetate substrate by means of a standard coating machine and dried.

The material was stored under various climatic conditions and subsequently tested for crosslinking by determining the layer melting point, the wet scratch resistance and the swelling factor. Good crosslinking is reflected in a high layer melting point, high wet scratch resistance and a low swelling factor.

The results are set out in the Table below. The methods described below were used for the individual determinations.

The crosslinking of the photographic material is determined by means of the melting point of the layers which is measured as follows:

The layer assemblage cast onto a support is semi-immersed in water continuously heated to 100° C. The temperature at which the layer runs off the support (streak formation) is called the melting point. When measured in this way, unhardened protein layers in no case show an increase in melting point. Under these conditions, the melting point is in the range from 30° to 35° C.

In order to determine water absorption, the test specimen is developed as a black sheet in a conventional colour development process and, after the final bath, is weighed after the surplus water has been stripped off. The specimen is then dried and re-weighed. Converted from the surface area of the test specimen to 1 square meter, the difference gives the water absorption per square meter.

Swelling is measured gravimetrically after a test strip has been treated for 10 minutes in distilled water at 22° C. It is expressed by the swelling factor:

$$\frac{\text{layer weight wet}}{\text{layer weight dry}} = \text{swelling factor}$$

To determine wet scratch resistance, a metal point of defined size is guided over the wet layer and subjected to an increasing load. The wet scratch resistance is expressed by that weight at which the point leaves a visible scratch mark behind on the layer. A heavy weight corresponds to a high wet scratch resistance.

| | Storage 36 h, 57° C., 34% rel. humidity | | | Storage for 7 days 36° C., 80% rel. humidity | | |
|---|---|---|---|---|---|---|
| Hardener | layer melting point | swelling factor | wet scratch resistance (p) | layer melting point | swelling factor | wet scratch resistance (p) |
| Compound 1 | | | | | | |
| 1 g | 100° C. | 4.8 | 100 | 100° C. | 3.3 | 400 |
| 2 g | 100° C. | 4.0 | 250 | 100° C. | 2.5 | 550 |
| 5 g | 100° C. | 3.0 | 350 | 100° C. | 2.1 | 800 |
| Compound 15 | | | | | | |
| 1 g | 100° C. | 4.6 | 100 | 100° C. | 3.5 | 400 |
| 2 g | 100° C. | 3.6 | 250 | 100° C. | 2.8 | 650 |
| 5 g | 100° C. | 3.2 | 400 | 100° C. | 2.7 | 750 |
| Compound 18 | | | | | | |
| 5 g | 100° C. | 5.1 | 100 | 100° C. | 3.5 | 350 |
| Compound 17 | | | | | | |
| 2 g | 100° C. | 5.2 | 250 | 100° C. | 3.8 | 350 |
| 5 g | 100° C. | 3.5 | 400 | 100° C. | 3.2 | 500 |
| Compound 16 | | | | | | |
| 2 g | 100° C. | 4.2 | 250 | 100° C. | 3.1 | 650 |
| 5 g | 100° C. | 3.9 | 350 | 100° C. | 2.8 | 750 |
| Comparison (without any hardener) | 38° C. | >7 | <150 | 38° C. | >7 | <150 |

It can be seen from Table 1 that layers resistant to boiling (melting point above 100° C.) are obtained with the addition of only 3 to 5 g of hardener per 100 g of gelatin. After storage at 36° C./80% relative humidity, hardening increases moderately without any over-hardening being obtained. The casting solutions may be left standing for 1 hour without any increase in viscosity, a sign of the required minimal crosslinking of the gelatin in the solution. Compared with the unhardened layer, the layers did not show any significant differences after development and fixing. There was no change in sensitivity, fog values or γ-values. The hardeners were inert to the silver halide emulsion, even after prolonged storage of the layers.

EXAMPLE 3

A colour reflection material was produced by applying the following layers successively to a polyethylene-lined paper substrate provided with an adhesive layer, the emulsion layers containing the usual additions of wetting agents, stabilizers etc., but no hardeners.

1. As undercoat, a 4μ thick blue-sensitive silver bromide emulsion layer containing per kg of emulsion 25.4 g of silver (88% AgBr, 12% AgCl), 80 g of gelatin and 34 g of the yellow component

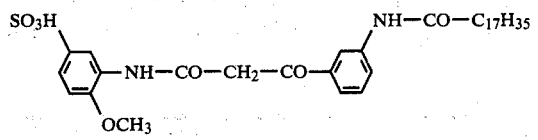

2. as intermediate layer, a 1μ thick gelatin layer, 3. as middle coat, a 4μ thick green-sensitive silver chloride bromide emulsion layer containing per kg of emulsion 22.6 g of silver (77% AgCl, 23% AgBr), 80 g of gelatin and 13 g of the magenta component the absence of moisture and after storage in a conditioned atmosphere.

The results are shown in the following Table.

| Hardener application | Addition | Melting point after storage of the layers at 22° C. (in the absence of moisture) 1 day | 2 days | 3 days | GF | WSR (38° C.) | Post-storage at 57° C./34% relative humidity hours) melting point | GF | WSR (38° C.) |
|---|---|---|---|---|---|---|---|---|---|
| 1/200 mole of compound I/100 ml | no addition | 40° C. | 40° C. | 40° C. | — | — | 100° C. | 2.7 | 350 |
| | 1/50 mole of $NaHCO_3$/100 ml | 100° C. | 100° C. | 100° C. | 2.6 | 350 | 100° C. | 2.3 | 400 |
| | 1/50 mole of Na-acetate/100 ml | 40° C. | 100° C. | 100° C. | 4.1 | 200 | 100° C. | 2.6 | 300 |
| Na-formate | 1/50 mole of 39° C. | 50° C. | 100° C. | 4.1 | 150 | 100° C. | 2.6 | 350 | |
| | 1/50 mole of Na-propionate | 40° C. | 40° C. | 100° C. | 4.0 | 200 | 100° C. | 2.4 | 350 |

GF = swelling factor in water at 22° C.
WSR = wet scratch resistance in a standard commercial colour developer at 38° C.

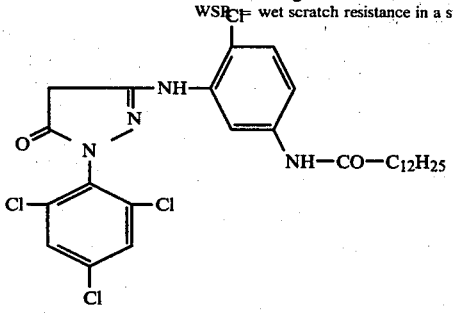

4. a 1μ thick intermediate layer as described in 2., 5. as overcoat a 4μ thick red-sensitive silver chloride bromide emulsion layer containing per kg of emulsion 23 g of silver (80% AgCl, 20% AgBr), 80 g of gelatin and 15.6 g of the cyan component

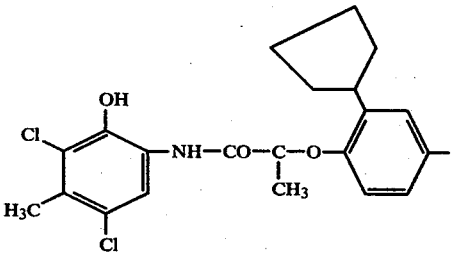

6. a 1μ thick protective layer of gelatin.

Aqueous solutions of 1/200 mole per 100 ml of compound 1, containing 1/50 mole of sodium bicarbonate, sodium formate, sodium acetate and sodium propionate per 100 ml of solution, were cast onto the dried layer assemblage and then dried. The layers were tested for crosslinking after storage for 1, 2 and 3 days at 22° C. in It can be seen from the Table that the entire layer assemblage is hardened by the hardening system which diffuses into it. In contrast to the comparison sample, in the case of which no buffering substance was added, hardening begins sooner where sodium bicarbonate, sodium formate, sodium acetate or sodium propionate is added and reaches a certain end point more quickly. It was found that hardening is greater when the hardening system is introduced by overcoating, i.e. after production of the layer assemblage.

Layers having comparable photographic values, such as sensitivity, fogging, gradation, were obtained after colour photographic processing in the usual processing baths. In this form, the hardening system according to the invention is inert with respect to the emulsion and the colour couplers.

EXAMPLE 4

The hardening effect is also accelerated in gelatin-containing photographic black-and-white materials by the addition of buffering substances. Quantities of 5 g of compound 1 were used per 100 g of gelatin. Quantities of 4 moles of sodium carbonate per mole of hardener were added to the casting solutions. A mixture containing no added buffer was used for comparison. The casting solutions contained 35 g of silver halide. The hardening properties were tested after the material had been stored in 4 different conditioned atmospheres.

Conditioned atmosphere 1: 23° C./30% relative humidity

Conditioned atmosphere 2: 23° C./50% relative humidity

Conditioned atmosphere 3: 57° C./34% relative humidity

Conditioned atmosphere 4: 36° C./90% relative humidity

The results are set out in the following Table.

| Addition of buffer | Conditioned atmosphere 1 layer melting point after 1 day | 2 days | 3 days | GF | WSR | Conditioned atmosphere 2 layer melting point after 1 day | 2 days | 3 days | GF | WSR | Conditioned atmosphere 3 GF | WSR | Conditioned atmosphere 4 GF | WSR |
|---|---|---|---|---|---|---|---|---|---|---|---|---|---|---|
| 4 moles per mole of hardener | | | | | | | | | | | | | | |
| Sodium hydrogen carbonate | 100° C. | 100° C. | 100° C. | 3.6 | 200 | 100° C. | 100° C. | 100° C. | 3.4 | 200 | 2.4 | 300 | 2.0 | 850 |
| Sodium acetate | 38° C. | 100° C. | 100° C. | 4.0 | 200 | 38° C. | 100° C. | 100° C. | 3.6 | 250 | 2.4 | 300 | 2.0 | 1000 |

-continued

| Addition of buffer | Conditioned atmosphere 1 layer melting point after 1 day | 2 days | 3 days | GF | WSR | Conditioned atmosphere 2 layer melting point after 1 day | 2 days | 3 days | GF | WSR | Conditioned atmosphere 3 GF | WSR | Conditioned atmosphere 4 GF | WSR |
|---|---|---|---|---|---|---|---|---|---|---|---|---|---|---|
| Sodium formate | 38° C. | 45° C. | 100° C. | 4.2 | 200 | 38° C. | 100° C. | 100° C. | 3.6 | 250 | 300 | 2.0 | 1000 | |
| no addition | 37° C. | 38° C. | 42° C. | — | — | 38° C. | 38° C. | 52° C. | — | — | 2.8 | 250 | 2.1 | 800 |

GF = swelling factor in water at 20° C.
WSR = wet scratch resistance at 50° C. as measured in the developer bath It can be seen from the Table that, where buffer substances are added to the layer, the melting point rises beyond 100° C. within a few days. Accordingly, the photographic materials thus hardened are suitable for processing at 38° to 50° C. after only brief storage. The photographic properties, such as fog, sensitivity and gradation, are not affected.

EXAMPLE 5

Samples of a photographic paper emulsion containing 80 g of gelatin and 35 g of silver halide per liter and 3% by weight of a crosslinking agent according to the invention were cast onto polyethylene-lined paper substrates provided with an adhesive layer. The usual casting aids, such as wetting agents, stabilizers and optical sensitizers were added to the emulsion samples beforehand. The layer melting points were determined immediately after drying.

After storage of the photographic material for 24 hours, the layer melting points were determined after passage at 22° C. through a photographic developer bath for black-and-white materials.

As can be seen from the following Table, the melting points are increased from 35° C. to far beyond 100° C. after a development time of 1.5 minutes, which is proof of hardening initiated spontaneously by the high pH-value of the developer solution. This Example demonstrates the uncertainty of a hardening process which is not carried out in accordance with the invention due to the latent activity of the crosslinking agents.

The developer solution had the following composition: 6 g of metol, 3 g of hydroquinone, 30 g of sodium sulphite, 25 g of anhydrous soda, 2 g of potassium bromide, water to 1 liter.

| Hardener | Melting point after drying | Melting point after developer bath 1.5 | 3 minutes |
|---|---|---|---|
| Compound 1 | 35° | 100° | 100° |
| Compound 3 | 35° | 100° | 100° |
| Compound 4 | 35° | 100° | 100° |
| Compound 15 | 35° | 100° | 100° |
| Compound 18 | 35° | 100° | 100° |

We claim:

1. A process for hardening a photographic silver halide material comprising of a support layer and at least one gelatin-containing layer applied thereto with a compound reacting with the amino groups of the gelatin as crosslinking agent, characterised in that a compound containing from 2 to 6 sulfonyl ethyl sulfate groups in the form of its salts is incorporated as crosslinking agent in the coating composition of the gelatin-containing layer(s) or the gelatin-containing layer(s) applied to the support layer, and in that the activity of the compound as a crosslinking agent is initiated by adjusting a pH-value in the range from 6.5 to 9 in the coating composition or in the range from 6.5 to 11 during the production process in the gelatin-containing layer.

2. A process as claimed in claim 1, characterised in that the crosslinking agent used is a compound corresponding to the following general formula $$Z(-Y-SO_2-CH_2-CH_2-OSO_3^{\ominus}Me^{\oplus})_n$$

in which

Z represents a 2-valent to n-valent aliphatic, saturated or olefinically unsaturated straight- or branched chain $C_1$–$C_9$-hydrocarbon radical which may be substituted and which may contain oxy groups, a 2-valent to n-valent, 6-membered cycloaliphatic, aromatic or heterocyclic radical which may be substituted, or the group $$NaSO_3-O-\underset{H}{C}=,$$

Y represents a single bond or, a branched or unbranched, $C_1$–$C_4$-alkylene group which may contain oxy, carbonyl and imino groups, and n is an integer of from 1 to 6.

3. A process as claimed in claim 1 or 2, characterised in that a pH-value of from 6.5 to 9 is adjusted by the addition of sodium tricarbonate or sodium acetate to the coating composition.

4. A process as claimed in claim 1 or claim 2, characterised in that the layer containing the crosslinking agent is overcoated with an aqueous buffer solution for a pH-value in the range from 6.5 to 11.

5. A process as claimed in claim 2, characterized in that said 6-membered cycloaliphatic, aromatic or heterocyclic radical which may be substituted is selected from the group consisting of cyclohexane, benzene, piperazine or hexahydrotriazine.

* * * * *